US005450798A

United States Patent [19]

Trenary

[11] Patent Number: 5,450,798

[45] Date of Patent: Sep. 19, 1995

[54] RAIL TRUCK FOR SUSPENDED CAR TRANSIT VEHICLES

[76] Inventor: Bryant Trenary, 3310 Fairmount 9E, Dallas, Dallas County, Tex. 75201

[21] Appl. No.: 373,013

[22] Filed: Jan. 17, 1995

Related U.S. Application Data

[63] Continuation of Ser. No. 66,497, May 25, 1993, Pat. No. 5,381,737.

[51] Int. Cl.[6] ..... B61B 3/00

[52] U.S. Cl. ..... 105/155; 105/148; 105/34.1; 105/199.4; 105/157.1; 105/182.1

[58] Field of Search ..... 104/89, 93, 94, 95, 104/124; 105/148, 149, 149.1, 150, 152, 154, 155, 156, 157.1, 182.1, 172, 199.1, 34.1, 84, 199.4

[56] References Cited

U.S. PATENT DOCUMENTS

| | | | |
|---|---|---|---|
| 1,454,937 | 5/1923 | Martin | 104/94 |
| 3,074,358 | 1/1963 | Matuszewski | 105/148 |
| 3,528,539 | 9/1970 | Speaker et al. | 104/89 |
| 3,800,707 | 4/1974 | Hermann | 104/94 |

FOREIGN PATENT DOCUMENTS

| | | | |
|---|---|---|---|
| 0538502 | 3/1957 | Canada | 104/94 |
| 0628704 | 10/1961 | Canada | 105/148 |
| 0681280 | 3/1964 | Canada | 104/94 |
| 1230294 | 9/1960 | France | 105/155 |
| 0529889 | 1/1930 | Germany | 105/148 |
| 0918203 | 2/1963 | United Kingdom | 104/94 |

*Primary Examiner*—Mark T. Le
*Attorney, Agent, or Firm*—Richards, Medlock & Andrews

[57] ABSTRACT

A rail truck for use in an elevated closed beam having a slot in the bottom surface for clearance of a car body support member. The passenger car body is hung beneath the beam and elevated above the ground with the trucks running inside the beam. The flanged wheels run on a pair of parallel rails with an electric power rail located above the center of the two running rails. The suspension permits restrained swinging of the passenger car in the lateral and longitudinal directions. A safety wheel is mounted to the frame to prevent upward movement of the frame to the extent that the wheel flanges on the running rails could climb over the top of the running rails. A pair of auxiliary climbing rails are mounted parallel to the power rail and above the running rails. Auxiliary climbing wheels on the truck are mounted on actuators which permit a controlled elevation of the auxiliary climbing wheels.

3 Claims, 4 Drawing Sheets

RAIL TRUCK FOR SUSPENDED CAR TRANSIT VEHICLES

CROSS REFERENCE TO RELATED APPLICATION

This is a continuation of U.S. patent application Ser. No. 08/066,497 filed May 5, 1993, and issued on Jan. 17, 1995 as U.S. Pat. No. 5,381,737.

TECHNICAL FIELD OF THE INVENTION

The present invention relates to a rail truck for a suspended car rail transportation system. More specifically, the present invention relates to a means of preventing derailment of the truck by external forces acting upon the truck and to provide additional tractive capability for ascending and descending steeper grades than are normally attainable by steel wheel on steel rail vehicles.

BACKGROUND OF THE INVENTION

Operation of a high speed suspended car rail system running on two rails is not described in the United States patent files. Rubber tired versions of suspended car systems using both solid and inflated tires have been built in the past. Single supporting rail suspended monorail systems have been built in the past. The potential of high speed operation requires that the attitude of the cars be securely controlled and derailment of the trucks carrying the cars be prevented. The inhibiting of vibration caused by the natural frequency of the cars and guideway being excited by car movement cannot be attained in rubber tired cars because elastomeric tires cannot dampen out the forces. Unattenuated vibration creates noise and causes metal fatigue in structures.

SUMMARY OF THE INVENTION

The principal objective of the present invention is to provide a truck, or bogie, that can operate inside a closed horizontal beam having a slot in lower surface for the car body support, that will eliminate the possibility of derailment of the truck due to forces acting upon the truck. A very high speed, 150 MPH to 200 MPH, operation will be affected by air currents caused by movement of the vehicle and surface winds. The forces from these air currents cannot be permitted to raise the light weight suspended cars to the extent that the flanged wheels can climb over the rails in the lateral direction.

It is also an objective of the present invention to provide a truck that can exert a greater normal force on the running rails to increase the traction available to ascend or descend steeper grades than can be safely ascended or descended relying on the force provided by the weight of the car and truck assembly alone. This added tractive capability will permit steel wheel cars on steel rails to safely negotiate the grades commonly encountered in major thoroughfares built for pneumatic tired vehicles.

The foregoing objectives can be accomplished by using an electric power delivering third rail inside the beam, mounted above the center of the two running rails, as an inverted third running rail with an insulated wheel running against this third rail effectively capturing the truck in the triangle formed by the three rails. The second objective of increasing the gradability of the truck is accomplished by using an actuator to force the auxiliary climbing wheels against the auxiliary climbing rails creating a downward force on the truck and running wheels providing for additional traction between a smooth steel wheel on a smooth steel rail.

When the transit system is a slow speed automated people mover the functions of the two listed objectives can be combined into one arrangement which uses the anti-derailment wheel as a vertically movable wheel to exert additional vertical reactive force on the two running rails.

DETAILED DESCRIPTION OF THE PREFERRED EMBODIMENT

Figure 1:
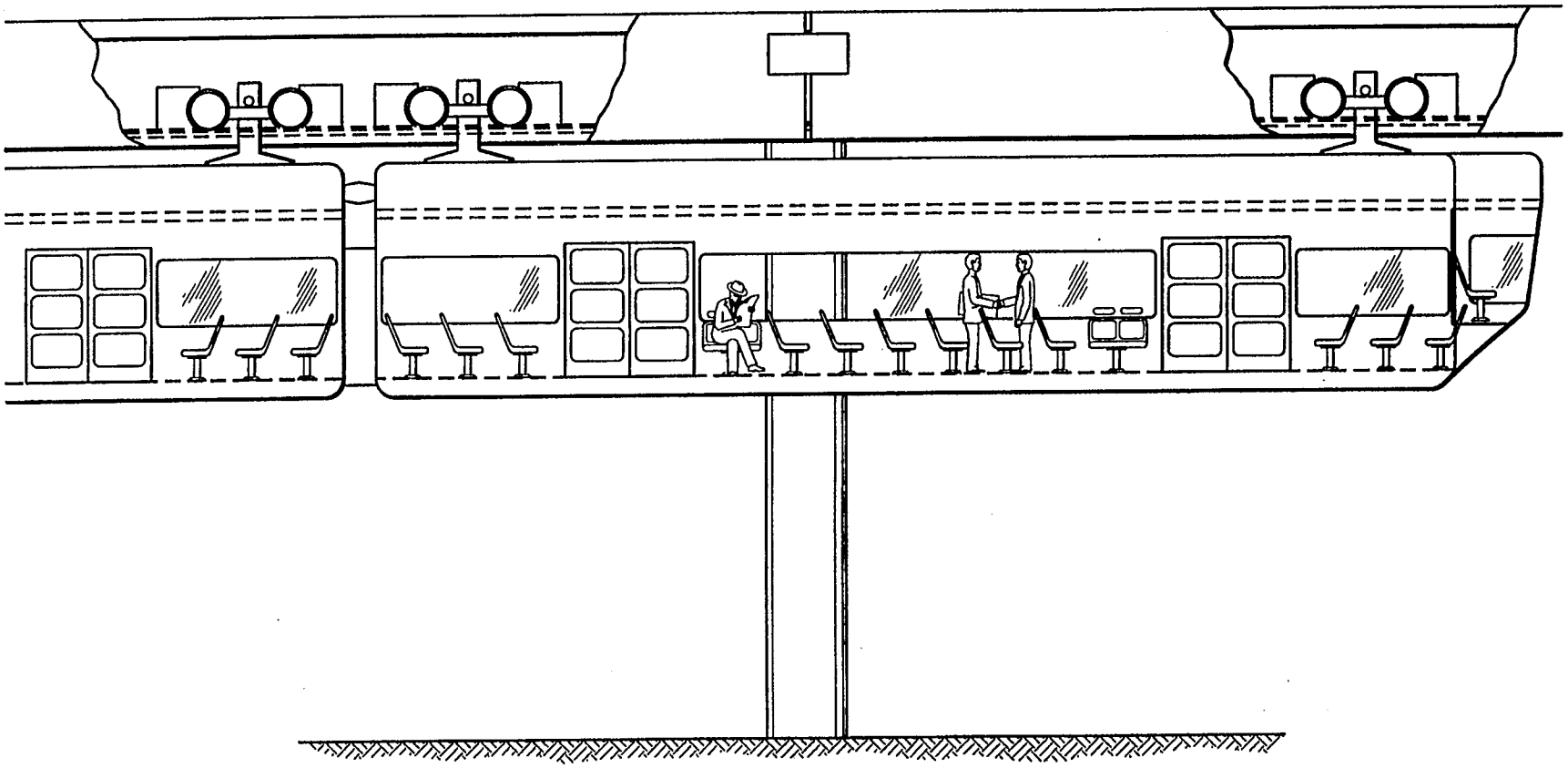
FIG. 1. is a pictorial view of the suspended transit cars that have (2) two-axle trucks running inside the horizontal beam.

As shown in the drawings the suspended car transit system will be elevated above the surface traffic in an unrestricted space which will permit very high rates of speed and acceleration. This unrestricted path permits the use of light weight composite materials in construction of the car bodies. This light weight means the cars will be affected by aerodynamic forces to a greater extent than heavier steel cars. A means of holding the cars to their trajectory in the environment of turbulent air currents is required for higher speeds possible with the suspended car transit applications. The vertical hydraulic suspensions permit the car to execute a limited lateral movement responding to centrifugal force in a high speed turn. As the track returns to a straight trajectory the car returns to the normal vertical position. This movement provides the maximum level of comfort for the passengers.

FIG. 1. shows the overall arrangement of a suspended car operation.

Figure 2:
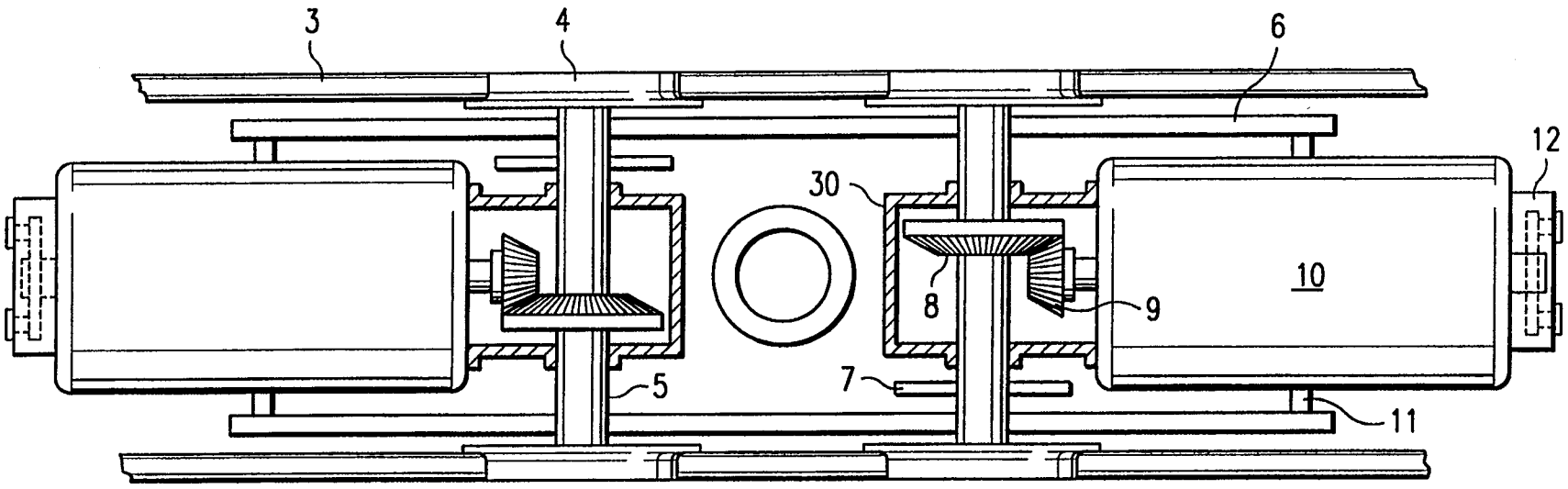
FIG. 2. is a top view of some principal mechanical components of the truck.

FIG. 2. shows the general layout of the basic mechanical components, the running wheels 4 on the two running rails 3 with the axle 5 mounted driven gear 8 and disk 7 for caliper brakes. The driving gear 9 is mounted on the output shaft of the electric motor 10 with the gear case 30 used to attach the driving end of the motor to the driven axle. A spring actuated hydraulically released parking brake 12 is mounted on the tail end shaft of the motor 10.

Figure 3:
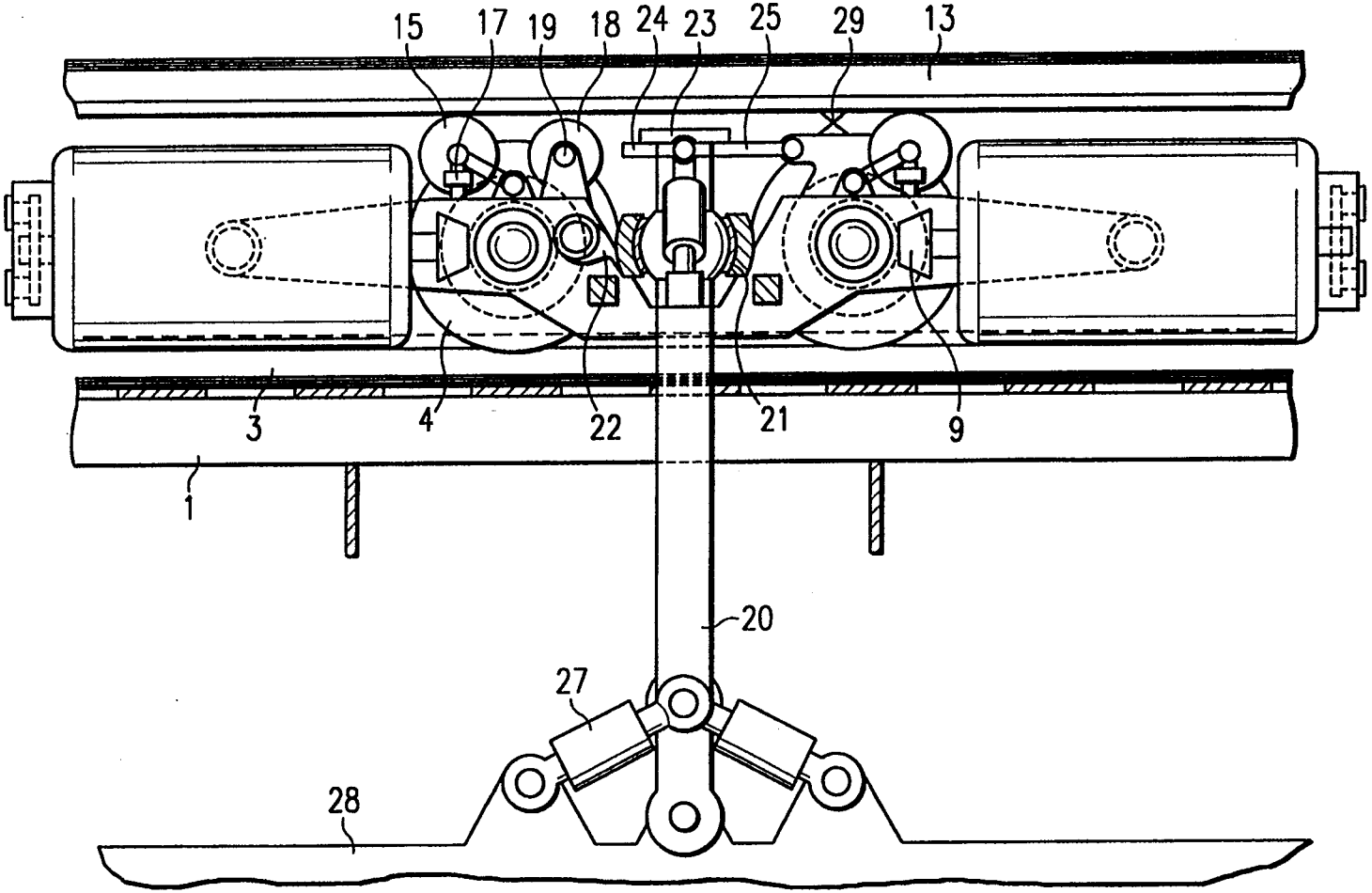
FIG. 3. is a side view of the truck.

FIG. 3. shows the auxiliary climbing wheels 15 that can be raised by the climbing wheel actuators 17 to create a reaction force at the running rail/running wheel interface which adds to the force on the running rails created by vehicle weight. The hard mounted safety wheel 18 clears the power rail by less than one-half inch. Upward movement of the truck will cause the safety wheel to contact the power rail before the running wheel flanges can clear the running rail to create a derailment. The car support shaft 20 has a shaft mounted thrust bearing 23 on the upper end which rests in a thrust bearing support 24. The thrust bearing support antirotation arm 25 keeps the thrust bearing support 24 from turning as the truck rotates relative to the car support shaft 20. The lower end of the car support shaft 20 is pinned to the car body 28, and the longitudinal shock absorber 27 permits limited movement of the car body 28 relative to the truck. The current collection shoe 29 slides along the power rail 13 as the electrical contact for one side of the direct current power system. The wheels 4 contacting the rails 3 provide the other side of the direct current power delivery.

Figure 4:
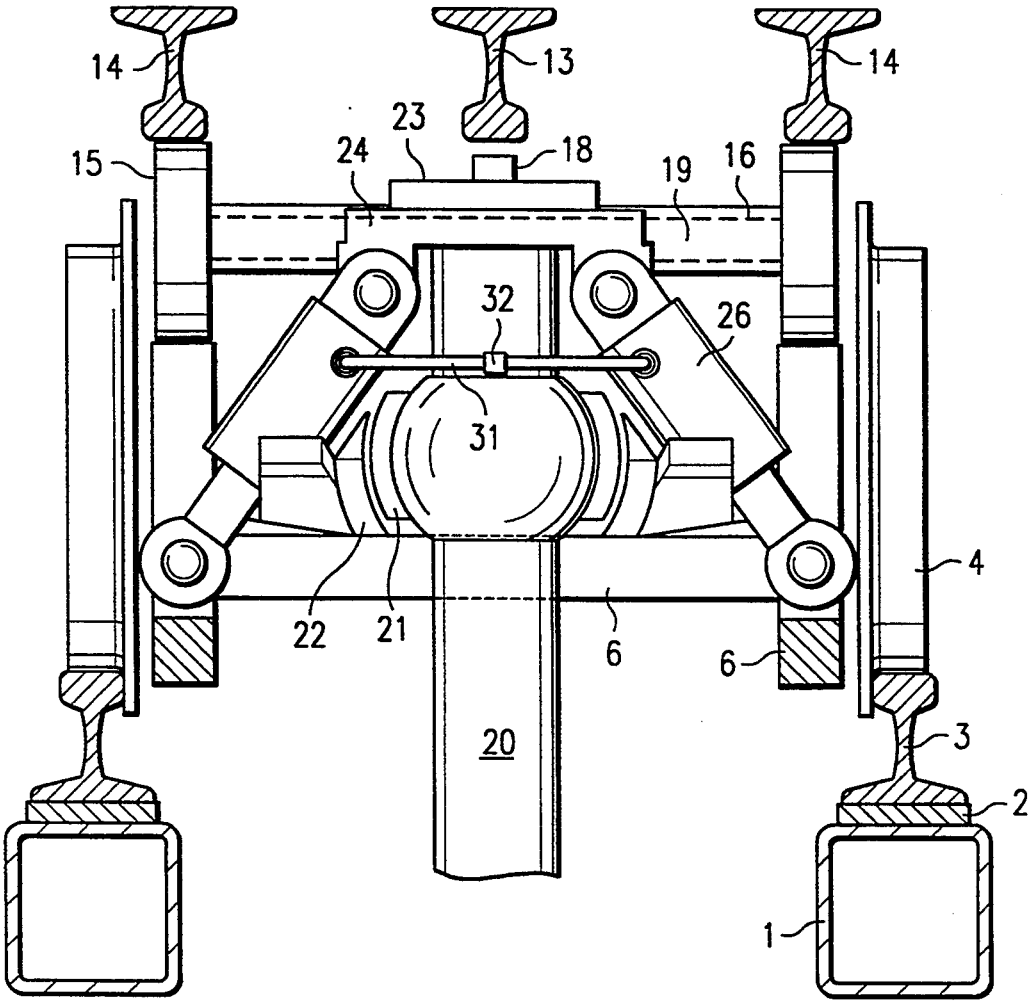
FIG. 4. is an end view of the truck.

FIG. 4. shows the rail support beam 1, the rail pad 2, and the running rail 3 which supports the running wheels 4. The truck frame 6 has the lower end of the vertical hydraulic suspension 26 attached. The upper end of the vertical hydraulic suspension 26 is attached to the thrust bearing support 24. The spherical portion of the car support shaft 20 is captured in the spherical bearing 21 which is held by the spherical bearing housing 22. The spherical bearing housing is hinged to the frame 6 so that the horizontal position of the spherical portion of the car body support shaft 20 is restricted in horizontal movement. The auxiliary climbing wheels 15 will be raised to contact the climbing rails when moved up by the actuators. The safety wheel 18 rides slightly below the power rail 13 when the running wheels are in contact with the running rails 3. The auxiliary climbing wheel axle 16 conceals the safety wheel shaft 19 in this view. The interconnecting line 31 between the two vertical load hydraulic suspensions 26 has a flow control 32 in the fluid path to control the roll rate and oscillation of the suspended cars.

I claim:

1. A rail truck assembly, comprising:

(a) a first running rail and a second running rail running parallel to each other above ground and spaced apart side to side;

(b) a power rail running at a generally constant distance above the first and the second running rails, the power rail conductive to electricity;

(c) a first wheel disposed on the first running rail for rolling along the top of the first running rail, the first wheel having a hub;

(d) a second wheel disposed on the second running rail for rolling along the top of the second running rail, the second wheel having a hub;

(e) a first axle with a first end connected at the hub of the first wheel and a second end connected at the hub of the second wheel;

(f) a truck frame mounted on the axle such that the axle rotates independently of the truck frame;

(g) a driving gear rotatively connected to the axle such that rotation of the driving gear rotates the axle and the first and second wheels to roll along the first and second running rails;

(h) an electric motor mounted to the truck frame and operatively connected to the driving gear for rotating the driving gear;

(i) a current collection shoe with one end in sliding contact with the power rail and another end electrically connected to the motor so that electricity can be conducted through the power rail to the shoe to the motor;

(j) a thrust bearing support mounted to the truck frame such that rotation of the thrust bearing support is prevented;

(k) a thrust bearing received in the thrust bearing support;

(l) a car support shaft with an upper end attached to the thrust bearing and a lower end opposite thereto;

(m) a car body pivotally connected to the lower end of the car support shaft;

(n) a spherical bearing pivotally connected to the truck frame at a point below the thrust bearing support such that movement of the spherical bearing in a horizontal direction is prohibited;

(o) the car support shaft defining a spherical portion at a point below the upper end of the car support shaft and said spherical portion being received in the spherical bearing; and (p) at least one pair of opposed hydraulic suspension members with upper ends attached to the thrust bearing support on opposite sides of the upper end of the car support shaft and lower ends attached opposite each other to the truck frame at a point below the spherical bearing, the lower ends being further from the car support shaft than the upper ends and oriented in a plane perpendicular to the direction of the first and second running rails such that swinging of the car support shaft is damped by the at least one pair of hydraulic suspension members.

2. The rail truck assembly of claim 1 further comprising:

(a) at least one interconnecting line with one end attached to a midpoint of one of the suspension members and the other end attached to a midpoint of the other suspension member so as to communicate hydraulic fluid between the pair of hydraulic suspension members; and (b) a flow control device mounted in the interconnecting line to control the transfer of hydraulic fluid between the hydraulic suspension members in response to the swinging of the car support shaft.

3. The rail truck assembly of claim 1 further comprising at least one shock absorber with a first end pivotally mounted to the car and a second end pivotally connected to a point on the car support shaft, the shock absorber oriented in a plane parallel with the first and second running rails.

* * * * *